US006367717B1

(12) United States Patent
Bonse

(10) Patent No.: US 6,367,717 B1
(45) Date of Patent: Apr. 9, 2002

(54) FUEL INJECTION VALVE FOR INTERNAL COMBUSTION ENGINES

(75) Inventor: Bernhard Bonse, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/554,010

(22) PCT Filed: Jun. 11, 1999

(86) PCT No.: PCT/DE99/01704

§ 371 Date: Jul. 7, 2000

§ 102(e) Date: Jul. 7, 2000

(87) PCT Pub. No.: WO00/14398

PCT Pub. Date: Mar. 16, 2000

(30) Foreign Application Priority Data

Sep. 9, 1998 (DE) ..... 198 41 158

(51) Int. Cl.[7] ..... B05B 1/30; F02M 59/00; F02M 39/00; F02M 51/00

(52) U.S. Cl. ..... 239/533.3; 239/533.1; 239/533.2; 239/585.5

(58) Field of Search ..... 239/533.1, 533.2, 239/533.3, 533.9, 533.7, 533.12, 584, 585.1, 585.2, 585.3, 585.4, 585.5, 586

(56) References Cited

U.S. PATENT DOCUMENTS

| | | | | | |
|---|---|---|---|---|---|
| 5,207,385 | A | * | 5/1993 | Turner | 239/533.3 |
| 5,449,121 | A | * | 9/1995 | El-Darazi et al. | 239/533.3 |
| 5,465,907 | A | * | 11/1995 | Hofmann | 239/533.9 |
| 5,718,385 | A | * | 2/1998 | Fontell | 239/533.3 |
| 5,875,973 | A | * | 3/1999 | Filiz et al. | 239/533.2 |
| 5,890,660 | A | * | 4/1999 | Stevens | 239/533.3 |
| 5,899,389 | A | * | 5/1999 | Pataki et al. | 239/533.2 |

* cited by examiner

*Primary Examiner*—James Hook
*Assistant Examiner*—Davis Hwu
(74) *Attorney, Agent, or Firm*—Ronald E. Greigg

(57) ABSTRACT

A fuel injection valve for internal combustion engines with a valve member that can move axially in a bore of a valve body and has a pressure shoulder on its shaft which acts in the opening direction of the valve member and protrudes into a pressure chamber that can be filled with high fuel pressure by way of a pressure conduit. This pressure conduit is pivoted eccentrically in such a way that the fuel jet emerging from the valve member enters into the pressure chamber off-center to the valve member.

6 Claims, 1 Drawing Sheet

FUEL INJECTION VALVE FOR INTERNAL COMBUSTION ENGINES

PRIOR ART

The invention is based on a fuel injection valve for internal combustion engines. In a fuel injection valve of this type which is known from DE 195 23 243 A1, a piston-shaped valve member is guided so that the value member moves axially counter to a closing force in a guide bore of a valve body that protrudes with one end into a combustion chamber of the internal combustion engine to be fed. On an end face oriented toward the combustion chamber, the valve member has a conical valve sealing face, which the value uses to cooperate with a stationary, conical valve sealing face on the closed end of the guide bore in the valve body in order to control a through flow cross section to an injection opening into the combustion chamber of the internal combustion engine to be fed. In this connection, the injection opening is embodied as an injection bore leading from the valve sealing face. On the shaft, the valve member has a pressure shoulder which is engaged by a prevailing high fuel pressure in the opening direction of the valve member, counter to a closing force of a valve spring. The pressure shoulder of the valve member protrudes into a pressure chamber which is comprised of a cross sectional widening of the guide bore. This pressure chamber is fed by a pressure conduit which leads from an axial end face of the valve body remote from the combustion chamber and, because of its entry being disposed on the radial outside, extends diagonal to the axis of the valve body. This pressure conduit is connected to a high-pressure fuel pump by way of corresponding supply lines so that the high fuel pressure is introduced into the pressure chamber by way of the pressure conduit. Another document, U.S. Pat. No. 3,511,442, has disclosed a fuel injection valve of this generic type in which the pressure chamber is shaped radially at one end for an improved incorporation of the inlet opening of the pressure conduit.

However, the known fuel injection valves have the disadvantage that even with a slight off-center position of the valve member, some injection openings remain largely closed during the opening stroke of the valve member, particularly when there is a small valve member opening its stroke, while the supply to the remaining injection openings occurs in a largely unthrottled manner. This results in an uneven fuel injection at the fuel injection valve, which occurs to a greater degree with so-called hole-type nozzles. In the known fuel injection valves, the above-described effect is encouraged because the outlet opening of the pressure conduit is directed into the pressure chamber centrally on the valve member so that a lateral force acts dynamically on the valve member and presses the valve member to the side at one end and thus impairs the central position that the value member requires for a uniform injection jet formation.

ADVANTAGES OF THE INVENTION

The fuel injection valve for internal combustion engines according to the invention, has an advantage over the prior art that a central position of the valve member is assured under all operating conditions of the injection valve. This is achieved in a structurally advantageous manner by virtue of the fact that the outlet opening of the pressure conduit extending into the pressure chamber is pivoted eccentrically out of a common longitudinal intersecting plane with the inlet opening. The two longitudinal intersecting planes of the inlet opening and outlet opening of the pressure conduit, which intersect the longitudinal axis of the valve body, enclose an angle around the longitudinal axis of the valve body in relation to each other. This pivoting of the pressure conduit achieves the fact that the fuel jet flowing from the pressure conduit into the pressure chamber is directed off-center to the valve member and therefore does not introduce any lateral forces onto the valve member. Moreover, a rotational flow is thus advantageously produced in the pressure chamber, which reduces flow losses and therefore reduces a pressure drop between the pressure conduit and the pressure chamber.

In the exemplary embodiment, the position of the pressure conduit according to the invention is described in a so-called sac-less nozzle, but can also be used in all other types of fuel injection valves, for example blind hole nozzles, pintle nozzles, etc., in which a jamming or tilting of the valve member impairs the fuel injection at the injection openings. Since the above-described impairment has a particularly strong effect with small valve member stroke steps, it is also particularly advantageous to use the disposition of the pressure conduit according to the invention in fuel injection valves which operate with two opening stroke steps, for example, so-called two-spring nozzle holders.

Other advantages and advantageous embodiments of the subject of the invention can be inferred from the specification, the drawings, and the claims.

BRIEF DESCRIPTION OF THE DRAWING

An exemplary embodiment of the fuel injection valve for internal combustion engines according to the invention is shown in the drawing and will be explained in detail below.

DESCRIPTION OF THE EXEMPLARY EMBODIMENT

Figure 1:
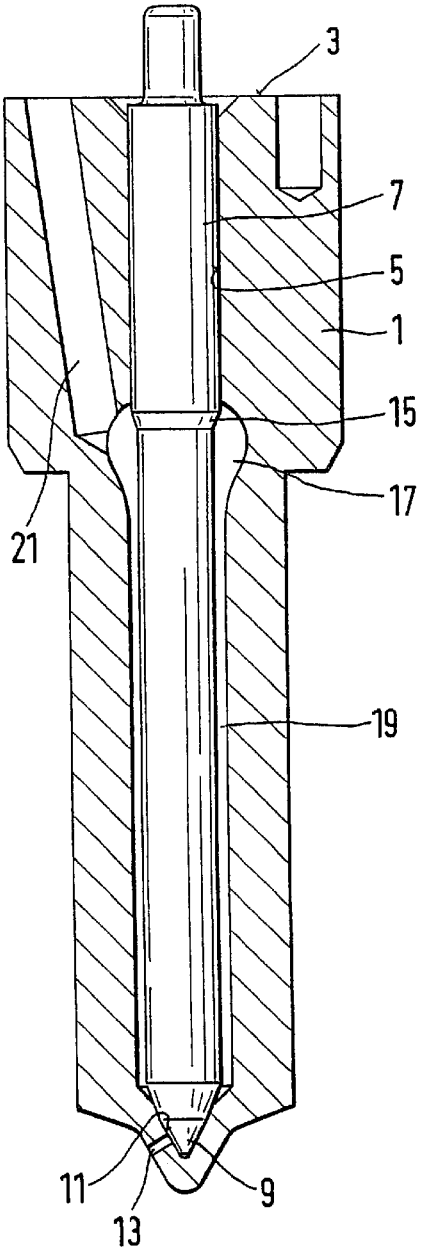
FIG. 1 is a longitudinal section through a part of the fuel injection valve oriented toward the combustion chamber.

The fuel injection valve for internal combustion engines shown in FIG. 1 has a valve body 1 which protrudes with a lower end into the combustion chamber of an internal combustion chamber that is not shown in detail and has a central bore 5 leading from an upper end face 3 remote from the combustion chamber. This bore 5, which is embodied as a blind bore, functions as an axial guide bore for a piston-shaped valve member 7, which is guided in a sealed fashion so that the value member can slide in the bore 5, at least in an upper section remote from the combustion chamber. On its lower end oriented toward the combustion chamber, the valve member 7 has a conically shaped valve sealing face 9 which the value member uses to cooperate with a conically shaped valve sealing face 11 on the valve body 1. The which valve sealing face is embodied on the inwardly protruding, closed end of the bore 5. In addition, an injection opening 13 leads from this valve seat face 11 and has an outlet that feeds into the combustion chamber of the internal combustion engine. The valve member 7 also has a pressure shoulder 15 on its shaft, which acts in an opening direction of the valve member 7 and is disposed at a cross sectional reduction of the pressure valve member 7 in a direction of the end oriented toward the combustion chamber. In this connection, the pressure shoulder 15 of the valve member 7 protrudes into a pressure chamber 17, which is formed by a radial widening of the bore 5 and extends by way of an annular conduit 19 until the pressure chamber reaches the valve seat face 11. In order supply high fuel pressure to the fuel injection valve, a pressure conduit 21 is provided in the valve body 1. The conduit enters into the radial widening of the bore 5 of the value body 1 remote from the combustion chamber radially outside the bore 5 and enters into the radially outer region of the pressure chamber 17 extending diagonally to the axis of the valve body 1.

Figure 2:
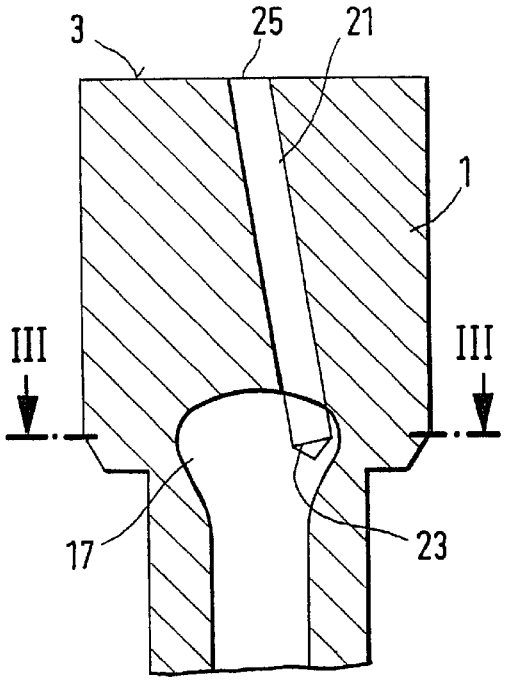
FIG. 2 shows an enlarged detail of the injection valve according to FIG. 1, in the vicinity of the pressure conduit.
Figure 3:
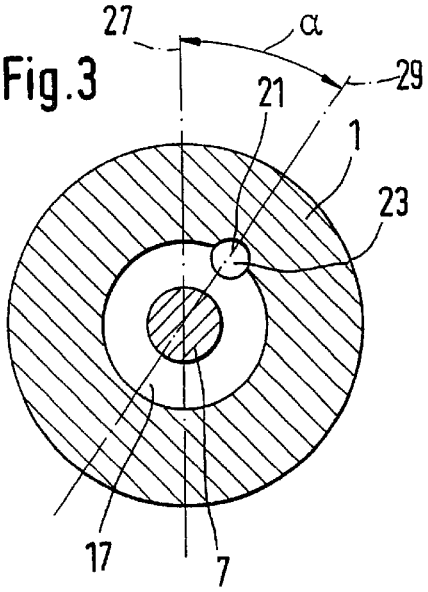
FIG. 3 is a cross section through FIG. 2 at a level of the inlet opening of the pressure conduit into the pressure chamber.

In order to prevent the fuel jet, which is flowing into the pressure chamber 17 by means of the pressure conduit 21, from laterally striking the valve member 7 and in order to prevent the attendant introduction of lateral force onto the valve member 7, the diagonally extending pressure conduit 21 is also pivoted eccentrically. As shown in FIGS. 2 and 3, an outlet opening 23 of the pressure conduit 21 into the pressure chamber 17 is pivoted out from a common longitudinal intersecting plane with an inlet opening 25 of the pressure conduit 21 on the upper end face 3. The inlet opening 25 of the pressure conduit 21 and its outlet opening 23 are now disposed in two different longitudinal intersecting planes that intersect the longitudinal axis of the valve body 1, which are pivoted in relation to each other around the longitudinal axis of the valve body 1. The pivot angle a between a first longitudinal intersecting plane 27 through the inlet opening 25 and a second longitudinal intersecting plane 29 through the outlet opening 23 of the pressure conduit 21 is approximately 35° in the exemplary embodiment, but can alternatively also be embodied as smaller or larger. It is only essential here that the oblique bore that constitutes the pressure conduit 21 is pivoted so that its outlet opening 23 into the pressure chamber 17 is disposed in such a way that the fuel jet emerging from the pressure conduit 21 enters the pressure chamber 17 off-center to the valve member 7 so that this fuel jet does not laterally strike the valve member and also produce a rotational flow in the pressure chamber 17.

The fuel injection valve for internal combustion engines according to the invention operates in a known manner, wherein the valve member 7 is initially held by a closing force, preferably a valve spring, in the closed position in which the valve sealing face 9 on the valve member 7 rest in a sealed fashion against the stationary valve seat face 11 so that the fuel flow from the annular conduit 19 to the injection opening 13 is closed. If a high-pressure fuel injection is intended to be carried out at the injection valve, high-pressure fuel flows from an external high-pressure fuel injection pump by way of pressure lines, not shown, into the pressure conduit 21 and on into the pressure chamber 17 and in this chamber, acts on the pressure shoulder 15 in the opening direction of the valve member 7. If this opening force exceeds the restoring force of the valve spring, the valve member 7 with its valve sealing face 9 is lifted up from the valve seat face 11 in a known manner, wherein by way of the then-opened opening cross section, the high-pressure fuel can flow from the pressure chamber 17 and the annular conduit 19 to the injection opening 13 and then reaches injection into the combustion chamber of the internal combustion engine. At the end of the high pressure fuel injection, the high fuel pressure in the pressure chamber 17 drops back below the necessary opening pressure level so that the closing force of the valve spring moves the valve member 7 back into sealed contact of the valve sealing face 9 against the valve seat face 11 and the valve member 7 thus closes the injection opening 13 in the fuel injection valve.

With the fuel injection valve according to the invention, it is thereby possible through structurally simple means to reliably prevent lateral forces from being introduced onto the piston-shaped valve member 7 and as a result to prevent a tilting of the valve member 7 and consequently an imprecise opening and closing.

The foregoing relates to a preferred exemplary embodiments of the invention, it being understood that other variants and embodiments thereof are possible within the spirit and scope of the invention, the latter being defined by the appended claims.

I claim:

1. A fuel injection valve for internal combustion engines, comprising a valve member (7), which moves axially in a valve member opening direction in a bore (5) of a valve body (1) that has a longitudinal axis, the valve member moving in the valve member opening direction counter to a closing force and has a valve sealing face (9) on an end face oriented toward a combustion chamber, the valve sealing face is used to cooperate with a stationary valve sealing face (11) in order to control a through flow cross section to an injection opening (13) into the combustion chamber of the internal combustion engine, a pressure shoulder (15) that is disposed on the valve member (7) and acts in the valve member opening direction, the valve member protrudes into a pressure chamber (17) that is filled with high fuel pressure by way of a pressure conduit (21), the pressure conduit (21) is disposed diagonal to the longitudinal axis of the valve body and leads from near an end face (3) of the valve body (1) remote from the combustion chamber and feeds fuel into a radially outer region of the pressure chamber (17), an inlet opening (25) of the pressure conduit (21) into the end face (3) of the valve body (1) remote from the combustion chamber and an outlet opening (23) of the pressure conduit (21) into the pressure chamber (17) are disposed in two longitudinal intersecting planes which intersect along the longitudinal axis of the valve body (1) and are pivoted in relation to one another around the longitudinal axis of the valve body (1).

2. The fuel injection valve according to claim 1, in which the pressure conduit (21) is embodied as an oblique bore whose outlet opening (23) into the pressure chamber (17) is pivoted in such a way that a fuel jet emerging from the pressure conduit (21) is directed off-center to the valve member (7).

3. The fuel injection valve according to claim 1, in which the outlet opening (23) of the pressure conduit (21) intersects the pressure chamber (17) on a circumference wall.

4. A fuel injection valve for internal combustion engines, comprising a valve member (7), which moves axially in a valve member opening direction in a bore (5) of a valve body (1) that has a longitudinal axis, the valve member moving in the valve member opening direction counter to a closing force and has a valve sealing face (9) on an end face oriented toward a combustion chamber, the valve sealing face is used to cooperate with a stationary valve sealing face (11) in order to control a through flow cross section to an injection opening (13) into the combustion chamber of the internal combustion engine, a pressure shoulder (15) that is disposed on the valve member (7) and acts in the valve member opening direction, the valve member protrudes into a pressure chamber (17) that is filled with high fuel pressure by way of a pressure conduit (21), the pressure conduit (21) is disposed diagonal to the longitudinal of the valve body and leads from near an end face (3) of the valve body (1) remote from the combustion chamber and feeds fuel into a radially outer region of the pressure chamber (17), an inlet opening (25) of the pressure conduit (21) into the end face (3) of the valve body (1) is disposed remote from the combustion chamber and in a first plane which includes the longitudinal axis of valve body, and an outlet opening (23) of the pressure conduit (21) into the pressure chamber (17) is disposed in second plane which includes the longitudinal axis of the valve body (1) and is pivoted in relation to the first plane around the longitudinal axis of the valve body (1).

5. The fuel injection valve according to claim 4, in which the pressure conduit (21) is embodied as an oblique bore whose outlet opening (23) into the pressure chamber (17) is pivoted in such a way that a fuel jet emerging from the pressure conduit (21) is directed off-center to the valve member (7).

6. The fuel injection valve according to claim 4, in which the outlet opening (23) of the pressure conduit (21) intersects the pressure chamber (17) on a circumference wall.

* * * * *